US006539598B1

(12) United States Patent
Weber

(10) Patent No.: US 6,539,598 B1
(45) Date of Patent: Apr. 1, 2003

(54) HINGE COMPONENT BLANK MADE FROM A ROLLED OR DRAWN PROFILED MATERIAL STRIP

(76) Inventor: Norbert Weber, Rennbahn 9-11, D-52062 Aachen (DE)

( * ) Notice: Subject to any disclaimer, the term of this patent is extended or adjusted under 35 U.S.C. 154(b) by 0 days.

(21) Appl. No.: 09/673,999

(22) PCT Filed: Apr. 28, 1999

(86) PCT No.: PCT/EP99/02871

§ 371 (c)(1),
(2), (4) Date: Nov. 30, 2000

(87) PCT Pub. No.: WO99/55993

PCT Pub. Date: Nov. 4, 1999

(30) Foreign Application Priority Data

Apr. 28, 1998 (EP) ..... 98107699

(51) Int. Cl.[7] ..... B21D 53/40; B21K 13/02

(52) U.S. Cl. ..... 29/11; 29/557; 29/897; 16/388; 16/392; 428/598

(58) Field of Search ..... 29/11, 557, 897, 29/897.3; 16/387, 388, 389, 390, 391, 392; 428/598, 577

(56) References Cited

U.S. PATENT DOCUMENTS

| | | | | | |
|---|---|---|---|---|---|
| 497,253 | A | * | 5/1893 | Reynolds | 428/582 |
| 1,053,493 | A | * | 2/1913 | Haiman | 428/598 |
| 1,602,422 | A | * | 10/1926 | Way et al. | 29/11 |
| 2,050,045 | A | * | 8/1936 | Eden, Jr. | 72/261 |
| 2,165,454 | A | * | 7/1939 | Cornell, Jr. | 29/890.148 |
| 2,239,202 | A | * | 4/1941 | Rendleman | 428/582 |
| 2,309,666 | A | * | 2/1943 | Parker | 29/890.148 |
| 4,237,577 | A | * | 12/1980 | Chapel | 16/262 |
| 4,283,811 | A | * | 8/1981 | George | 16/390 |
| 4,785,498 | A | * | 11/1988 | Brotschi | 16/238 |
| 4,864,688 | A | * | 9/1989 | Gerber | 16/261 |
| 5,067,200 | A | * | 11/1991 | Stowell et al. | 16/237 |
| 5,219,372 | A | * | 6/1993 | Lee | 16/54 |
| 5,408,785 | A | * | 4/1995 | Heim et al. | 49/502 |
| 5,452,501 | A | * | 9/1995 | Kramer et al. | 29/11 |
| 5,493,888 | A | * | 2/1996 | Merkle et al. | 72/359 |
| 5,529,198 | A | * | 6/1996 | Reynard | 220/1.5 |
| 5,561,886 | A | * | 10/1996 | Flamme | 16/265 |
| 5,564,775 | A | * | 10/1996 | Ebert et al. | 296/202 |
| 6,148,481 | A | * | 11/2000 | Chen | 16/334 |
| 6,353,967 | B1 | * | 3/2002 | Escobar et al. | 16/331 |
| 6,438,800 | B1 | * | 8/2002 | Narang et al. | 16/389 |
| 6,450,003 | B1 | * | 9/2002 | Pawson | 72/457 |

FOREIGN PATENT DOCUMENTS

| | | | | |
|---|---|---|---|---|
| DE | 19509674 A1 | | 9/1996 | |
| DE | 19603149 A1 | | 7/1997 | |
| EP | 732473 | * | 9/1996 | E05D/9/00 |
| JP | 359001045 | * | 1/1984 | B21K/23/00 |

* cited by examiner

*Primary Examiner*—Gregory M. Vidovich
*Assistant Examiner*—Essama Omgba
(74) *Attorney, Agent, or Firm*—Pandiscio & Pandiscio

(57) ABSTRACT

In a hinge-part blank made from a rolled or drawn profiled strip of stock that is separated into the individual hinge-part blanks by beam-cutting along an oblique boundary line (I) followed by parting along a parting line (II), the profiled strip of stock has a T- or Y-shaped cross section and is separated into the individual hinge-part blanks by beam-cutting along the boundary lines (I) and the parting lines (II) and is separated at that time in the region of the hinge head (7 or 8) by means of a saw cut along a parting line (III).

4 Claims, 1 Drawing Sheet

HINGE COMPONENT BLANK MADE FROM A ROLLED OR DRAWN PROFILED MATERIAL STRIP

The invention relates to a hinge-part blank made from a rolled or drawn profiled strip of stock.

Known from DE 195 09 674 C2 is a hinge blank consisting of a first hinge-part blank and a second hinge-part blank and a method for its production, wherein the corresponding rolled or drawn profiled strip has a profile that corresponds to the desired hinge-part blank and the individual hinge-part blanks are separated into the individual hinge-part blanks by being severed along predetermined boundary and parting lines.

During the development of this hinge-part blank and the production method provided for it, it was found that although the quality of the surfaces produced by beam cutting was good enough for the outer boundary lines of the hinge-part blanks, the quality of the surfaces formed by beam cutting along the parting lines and constituting the mating sliding surfaces of the finished hinge were [sic] sometimes inadequate for this purpose in terms of surface quality.

Furthermore, the ability to choose the design of the hinge-part blank is limited for functional reasons by the type of nesting set forth in DE 19 509 674 C2.

With hinge-part blanks made by the above-cited known production method, it was therefore necessary to subject these mating sliding surfaces to further machining, thus increasing the production cost of the finished hinge.

The object of the invention is not only to be able to produce a hinge-part blank from rolled or drawn profiled strips of stock at lower cost by eliminating such additional machining, but also to allow greater freedom of design of the hinge-part blank due to the different type of nesting.

This object is accomplished according to the invention in that for a hinge-part blank made from a rolled or drawn profiled strip of stock, a special cross-sectional shape is provided for the profiled stock in combination with a novel nesting arrangement and a different sequence of severing steps.

The fact that the profiled strip has a T- or Y-shaped cross section, which is separated in the region of the hinge head by, for example, a severing cut made with a saw along a parting line III, and the hinge fastening leaves and hinge brackets are separated into individual hinge-part blanks by severing them along boundary lines I and parting lines II, makes it possible for the hinge-part blanks to be produced in a cost-effective manner with great freedom of design of the blanks.

Figure 1:
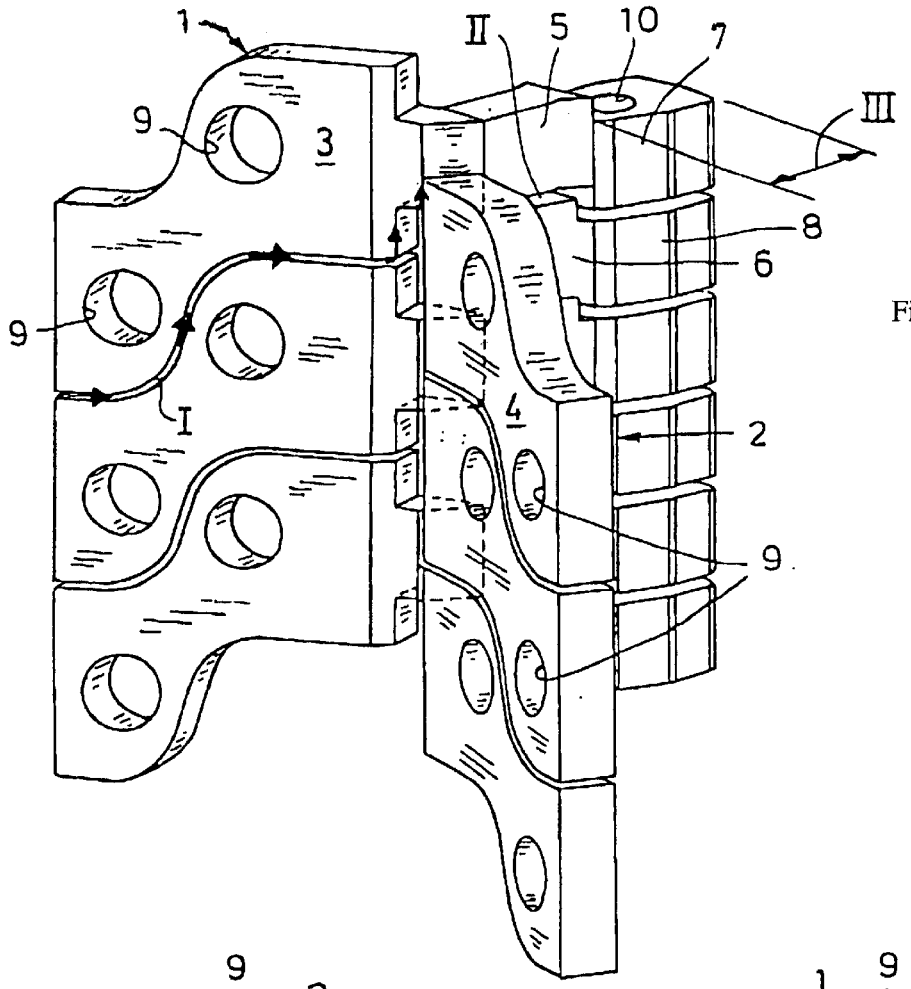
Figure 2:
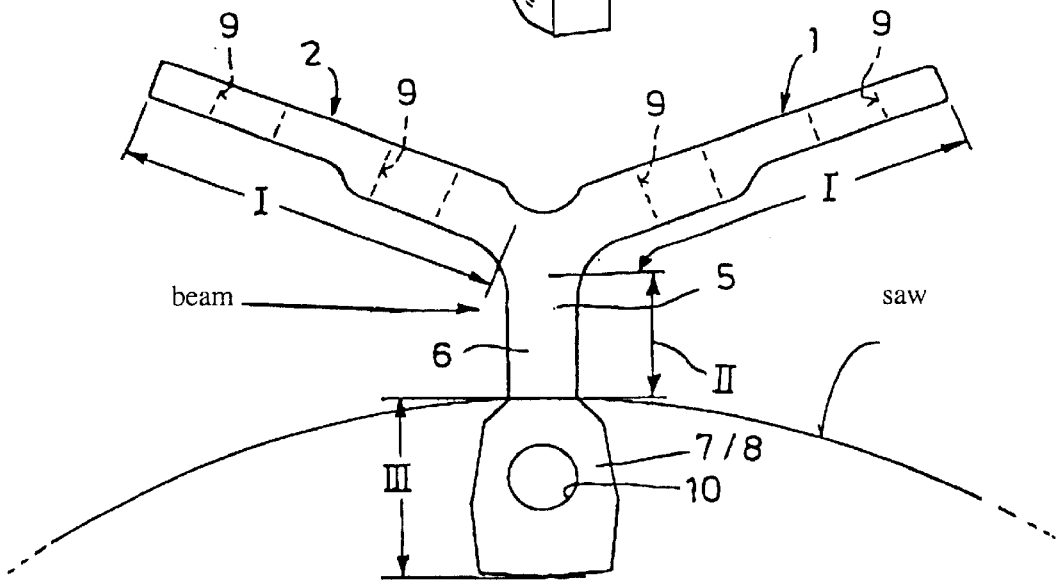

The invention is explained in more detail with reference to an exemplary embodiment depicted in the appended drawings, wherein:

FIG. 1 is an oblique view of a profiled strip of stock for a hinge-part blank according to the invention in the novel T or Y shape with the corresponding boundary lines and parting lines, and FIG. 2 is the cross section of the profiled strip of stock according to the invention, showing the severing lines.

FIG. 1 shows a rolled or drawn profiled strip for a body-side hinge-part blank of a motor-vehicle door, the nesting of the hinge-part blank being done in such a way that a hinge-part blank 1 and a hinge-part blank 2 are nested such that their respective fastening leaves 3 and 4 with the respective brackets 5 and 6 for the respective hinge eyes 7 and 8 to receive the hinge pin are disposed in the manner of a T-shaped or Y-shaped bar, yielding particular advantages in terms of the design of the hinge-part blanks and the guidance of the various severing cuts.

In FIGS. 1 and 2, openings 9 for the securing pins are provided and indicated in fastening leaves 3 and 4, and a bore 10 to receive the hinge pin (not shown) is provided and indicated in hinge heads 7 and 8. Said openings 9 can be made either before the severing cuts or not until after the profiled strip of stock furnishing the hinge-part blanks has been separated into the individual hinge-part blanks, specifically by appropriate severing, punching or drilling.

The beam cuts made to separate fastening leaves 3 and 4 extend along boundary lines I and brackets 5 and 6 are severed by beam-cutting along parting lines II, whereas hinge heads 7 and 8 are severed by means of a saw cut III which yields at that time the desired quality of the sliding surface in the region of the hinge pin. (The contour of the saw blade used for this purpose is indicated in FIG. 2.)

In FIG. 2, the corresponding cuts are also shown with the same reference numerals for the beam-cut boundary lines I, the parting beam lines II and the sawcut line, designated as III.

This nesting concept can be used equally well for body-side and for door-side hinge parts, a right and a left hinge-part blank being made simultaneously from one profiled strip.

Owing to the geometry of a door-side hinge-part blank (not shown), cut II can optionally be eliminated.

In general, the T- or Y-shaped nesting method permits flexibility of design of the hinge parts with the use of various parting methods to achieve the desired surface quality for the part at predefined panting planes.

Characteristic of the invention is its suitability for the low-waste production of hinge-part blanks from an initially multi-legged profiled strip. To accomplish this, the fastening leaf of a first hinge-part blank is separated from a first leg of the profiled strip of stock and the fastening leaf of a second hinge-part blank is separated from a second leg of the profiled strip of stock.

Disposed in a further leg of the profiled strip of stock are the hinge heads 7, 8, which are separated from this leg by a cut made along line III, said cut running rectilinearly and vertically to the longitudinal extension of the profiled strip of stock.

The first or second hinge-part blank is then separated from the first or second leg of the profiled strip of stock by a freely adjustable cut along line I of the first or second hinge-part blank.

FIG. 1 further shows that the additional leg has a web profile between the hinge head 7 and the place where it joins the first and second legs, from which profile the respective brackets 5 and 6 of the first and second hinge-part blanks are produced by severing the additional leg (directed rearward in the drawing) by means of an additional cut along line II. The path of the cut is theoretically also freely adjustable.

In particular, FIG. 1 shows a path for cut II that runs rectilinearly and vertically to the longitudinal extension of the profiled strip of stock.

It will be readily appreciated from FIGS. 1 and 2 that in each case a plurality of the rectilinearly extending cuts along line III and a plurality of any additional freely adjustable cuts along line I can be made simultaneously, so that a large number of hinge-part blanks can be finished simultaneously in this manner.

In addition, FIG. 1, in particular, shows that the fastening leaves of the hinge-part blanks are nested together in their respective assigned legs of the profiled strip of stock, so that they can be parted along a common path line. This produces the advantage that only one severing cut need be made to produce any two adjacent fastening leaves. This advantage is achieved by the fact that the mutually confronting contour lines of two adjacent fastening leaves correspond to with each other as a positive and a negative contour.

If the angle between the additional leg that is directed rearward in FIG. 1 and at least one of the first and second legs is at least 90°, the severing cut for making the hinge-part blanks from the first or second leg can be guided through the stock of the profiled strip without colliding with the additional common leg, so that practically no waste is generated in the production of the hinge-part blanks.

The cut along line II may be made by sawing, milling or beam cutting. Numerically controlled beam-cutting is preferred in view of the practically waste-free conduct of this method. The cuts along lines I and II may be made by a beam-cutting method, such as watedjet cutting, abrasive waterjet cutting, plasma cutting, and laser cutting.

The bore 10 on the hinge head is advantageously made after the individual cuts I, II and III. Said bore 10 is at the end of the hinge head that originally faces away from the first and second legs of the profiled strip of stock.

The openings 9 used to fasten the hinge parts in installed condition are also advantageously not made until after the severing cuts I, II and III.

These measures offer the advantage of easy handling of the parts for further processing.

Further, it can be seen from the depiction of FIG. 1 that the thickness of the hinge head 7 is about half as great as the widthwise dimension, in the same direction, of fastening leaf 3 or 4 cut respectively from the first or second leg.

Also of particular advantage is a cutting path for cut III that runs rectilinearly and vertically to the axis of the preferably subsequently made bore 10, since the cut surface can then also form the sliding plane of the hinge, which ensures the exact guidance of the vehicle door at a preset height.

What is claimed is:

1. A hinge part blank assembly comprising a plurality of hinge part blanks integral with each other, each of said hinge part blanks being adapted to serve as at least one of a motor vehicle body side hinge and a motor vehicle door side hinge, the assembly having a selected one of a Y-shaped configuration and a T-shaped configuration, each of said hinge part blanks comprising a plurality of leaf portions, each extending from a bracket portion, each of said leaf portions having openings therein for receiving securing pins and each of said bracket portions having a bore therein for receiving a hinge pin, a first group of said leaves being aligned to from a first leg of the selected configuration of blank assembly, a second group of said leaves being aligned to form a second leg of the selected configuration of blank assembly, and the bracket portions extending from the leaves of the first and second legs being in a single alignment to form a third leg of the selected configuration of blank assembly, the blank assembly being divisible and separable to provide individual ones of the motor vehicle body side and motor vehicle door side hinge parts.

2. The assembly accordance with claim 1 wherein each the individual hinge parts comprises one of said leaf portions integral with one of the bracket portions.

3. The assembly in accordance with claim 2 wherein the assembly is divisible and separable along lines susceptible to cutting so as to provide equally configured hinge parts, each having an equally configured leaf portion and an equally configured bracket portion.

4. The assembly in accordance with claim 2 wherein the assembly is divisible and separable along lines susceptible to cutting so as to obtain from a first hinge part blank equally configured hinge parts and from a second hinge part blank equally configured hinge parts, the hinge parts from the first hinge part blank being different in configuration from the hinge parts from the second hinge part blank.

* * * * *